US006220160B1

(12) United States Patent
Weber et al.

(10) Patent No.: US 6,220,160 B1
(45) Date of Patent: Apr. 24, 2001

(54) INK FEEDING SYSTEM AND METHOD FOR A PRINTING, DUPLICATING OR LIKE MACHINES

(76) Inventors: David C. Weber; Frederic Valentini, both c/o Tri Service, Inc., 1942 N. 15th Ave., Melrose Park, IL (US) 60160

( * ) Notice: Subject to any disclaimer, the term of this patent is extended or adjusted under 35 U.S.C. 154(b) by 0 days.

(21) Appl. No.: 09/374,370

(22) Filed: Aug. 13, 1999

(51) Int. Cl.[7] ..... B41J 29/42

(52) U.S. Cl. ..... 101/350.1; 101/364; 101/366; 222/325; 222/327

(58) Field of Search ..... 101/350.1, 355, 101/256, 360, 363, 364, 365, 366, 367, 351.8, 112, 119; 222/185.1, 325, 326, 327, 389, 642

(56) References Cited

U.S. PATENT DOCUMENTS 3,045,592 * 7/1962 Shearer et al. ..... 101/350.1
3,099,211 * 7/1963 Hilgoe et al. ..... 101/366 X
3,631,800 * 1/1972 Mignone et al. ..... 101/366
4,155,304 * 5/1979 Schweisser ..... 101/366
4,978,042 * 12/1990 Fidler ..... 222/642
5,029,672 * 7/1991 Witczak ..... 184/7.4
5,226,897 * 7/1993 Nevens et al. ..... 604/218
5,724,890 * 3/1998 Deschner et al. ..... 101/366
5,819,450 * 10/1998 Alexander et al. ..... 222/179
5,878,667 * 3/1999 Ryan ..... 101/366

* cited by examiner

*Primary Examiner*—John S. Hilten
*Assistant Examiner*—Minh Chau
(74) *Attorney, Agent, or Firm*—John R. Hoffman

(57) ABSTRACT

An ink feeding system for feeding ink to an ink fountain of a printing, duplicating or like machine includes a can holder for holding a can of printing ink. A support arm suspends the can holder and can above the ink fountain. A piston-and-cylinder device feeds ink from the suspended can through a hole in the closed bottom end of the can and into the ink fountain. A disposable gasket is placed on top of the ink in the can for engagement by a piston head of the piston-and-cylinder device.

3 Claims, 2 Drawing Sheets

FIG. 1
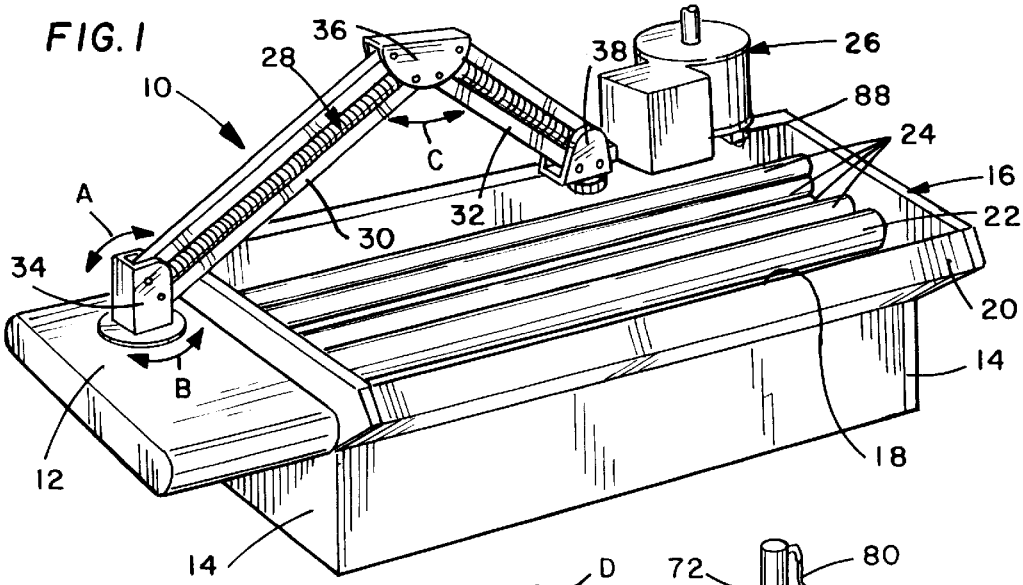
FIG. 2
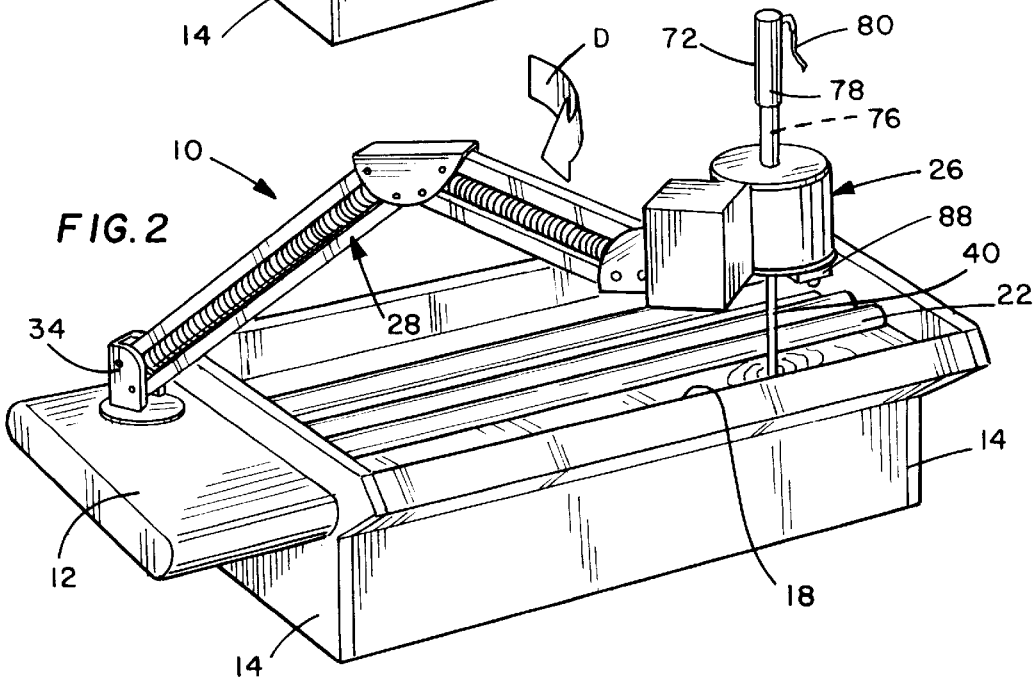
FIG. 4
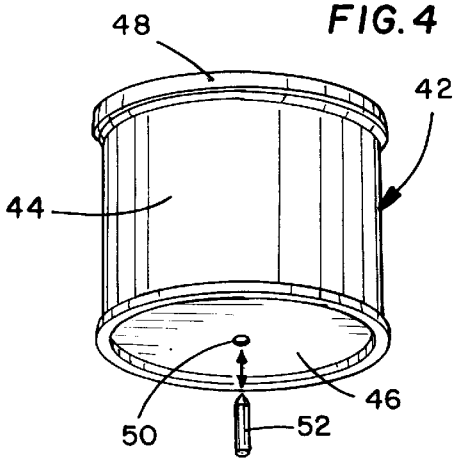
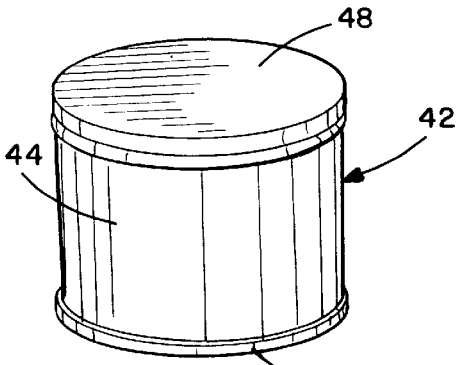
FIG. 3

INK FEEDING SYSTEM AND METHOD FOR A PRINTING, DUPLICATING OR LIKE MACHINES

FIELD OF THE INVENTION

This invention generally relates to the art of printing or duplicating machines and, particularly, to a system or method for feeding ink to an ink fountain of the machine.

BACKGROUND OF THE INVENTION

Printing machines normally include a printing couple which comprises a number of cylinders and/or rollers such as impression cylinders, master cylinders, blanket cylinders, ductor rollers, transfer rollers, oscillating rollers, form rollers, and the like. For instance, a printing head may be provided generally at the top of the machine, often at the rear of the machine, and which includes an ink fountain for feeding ink to the various rollers of the printing couple which transfers images to copy sheets. A number of rollers which generally can be termed "distribution" rollers are provided between the ink fountain and the printing couple for distributing ink to the printing couple. The distribution rollers conventionally are mounted between spaced side frame plates of the machine framework.

One of the problems with printing machines of the character described above is the continuing time consuming, inefficient and "messy" processes or systems for feeding or adding printing ink to the ink fountain.

This is particularly problematic with offset or "four color" printing processes wherein different colors of ink must be changed for any single printing run.

Printing ink is manufactured and supplied in typical cans very similar to ordinary cans of paint, but with a different type of lid. The ink cans are cylindrical, with a closed bottom end and fairly conventional dimensions. It is not uncommon for ink to be fed to the ink fountain of a printing machine simply by manually pouring the ink from the can. Printing ink is very thick or viscous, and such manual processes are time consuming, inaccurate and often a messy or sloppy job. Rarely are the full contents of an ink can poured into the ink fountain. Mechanized ink feeding apparatus have been used, but such apparatus most often are for large printing machines and are very elaborate and expensive.

The present invention is directed to solving these problems and providing a very simple, inexpensive and efficient apparatus, system or method of feeding or supplying ink to a printing couple of a printing machines

SUMMARY OF THE INVENTION

An object, therefore, of the invention is to provide a new and improved feeding system or method of supplying ink to an ink fountain of a printing, duplicating or like machine.

In the exemplary embodiment of the invention, the system includes a can holder for holding a conventional can of printing ink. A support suspends the can holder and can above the ink fountain. Feeding means are provided for feeding ink from the suspended can into the ink fountain.

As disclosed herein, the support includes an articulated arm for suspending the can at different positions above the ink fountain. The can holder comprises a housing on a distal end of the articulated arm. The housing has an interior cavity sized complementary to the conventional can, along with a door for closing the cavity. Normally open switch means are provided on the housing and operatively associated with the feeding means, the switch means being closable by the door in a closed position. Additional normally open switch means may be provided on the housing and closable by the can positioned within the cavity in the housing.

The feeding means comprises a piston-and-cylinder device for forcing ink from the can into the ink fountain. A disposable gasket is fitted into the can and is engageable by a piston head of the piston-and-cylinder device. A sensor may be provided at the ink fountain operatively associated with the feeding means for feeding ink in response to sensing a given level of ink in the ink fountain.

The invention contemplates a method which includes the steps of forming a hole in the closed end of the ink can. The lid is removed from the opposite end of the can, and a gasket is positioned into the can onto the surface of the ink. The feeding means, such as the piston-and-cylinder device, then applies pressure to the gasket to force ink from the can through the hole in the can and into the ink fountain. The gasket is an inexpensive, readily disposable component of the system and protects the feeding means, such as the piston of the piston-and-cylinder device, from coming into any direct contact with the ink in the can.

Other objects, features and advantages of the invention will be apparent from the following detailed description taken in connection with the accompanying drawings.

BRIEF OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 1 is a perspective view of the ink feeding system of the invention, mounted generally above an ink fountain of a printing head;

FIG. 2 is a view similar to that of FIG. 1, with the can holder moved to a position directly above the ink fountain and showing ink being dispensed into the fountain;

FIG. 3 is a top perspective view of a conventional can of printing ink;

FIG. 4 is a bottom perspective view of the can, and showing a hole being formed in the bottom closed end of the can;

DETAILED DESCRIPTION OF THE PREFERRED EMBODIMENT

Figure 5:
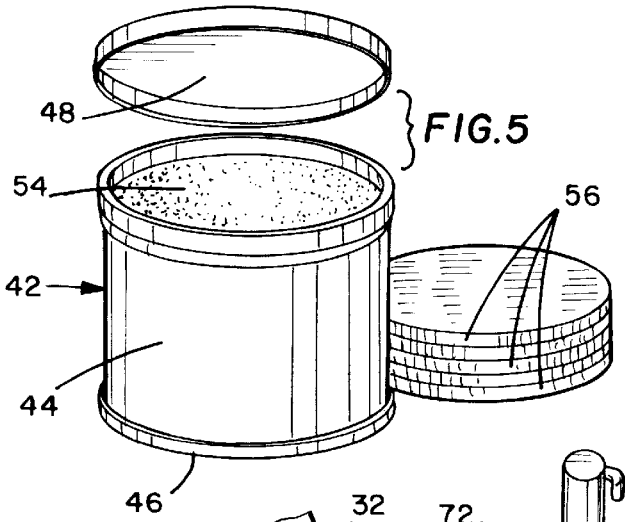
FIG. 5 is a perspective view of the can, with the lid removed and in conjunction with a stack of disposable gaskets according to the invention.

Referring to the drawings in greater detail, and first to FIG. 1, the invention is embodied in an ink feeding apparatus or system, generally designated 10, mounted on a platform 12 projecting outwardly from a side frame plate 14 of a printing head, generally designated 16. The printing head is part of a printing couple of a printing, duplicating or like machine and includes an ink fountain 18 defined between an inclined wall 20 of the framework and an ink roller 22. The printing head includes a number of rollers 24 which generally can be termed "distribution" rollers for providing ink from ink fountain 18 to the printing couple of the machine. The distribution rollers are mounted between side frame plates 14 of the machine framework.

Ink feeding system 10 generally includes an ink can holder, generally designated 26, mounted on the distal end of an articulated support arm, generally designated 28. The articulated support arm includes a pair of arm portions 30 and 32. Arm portion 30 is mounted by a swivel bracket 34 to platform 12, whereby arm portion 32 can pivot in a vertical direction as indicated by arrow "A" as well as swivel in a horizontal direction as indicated by arrow "B". Arm portions 30 and 32 are interconnected by a pivot bracket 36, whereby the arm portions are pivotable relative to each other in the direction of arrow "C". Can holder 26 is connected by a pivot bracket 38 to the distal end of arm portion 32 so that the can holder can be maintained in a horizontal disposition.

While FIG. 1 shows can holder 26 positioned horizontally away from ink fountain 18, FIG. 2 shows articulated support arm 28 having moved the can holder in the direction of arrow "D" to a position immediately above ink fountain 18 whereat ink can be deposited into the fountain, as at 40. The articulated support arm allows for the can holder to be positioned anywhere along the length of the ink fountain as well as to be moved horizontally completely away from the printing head to allow for cleaning, service or the like.

FIGS. 3 and 4 show a conventional ink can, generally designated 42, for holding a supply of ink. The can is typical and includes a cylindrical side wall 44, a closed bottom wall 46 and a removable lid 48. The can is on the order of 6¾ inches high and 6⅞ inches in diameter. As will be described in greater detail hereinafter, the system and method of the invention contemplates forming a hole 50 in bottom wall 46 by means of a punch, drill or like tool 52.

Figure 6:
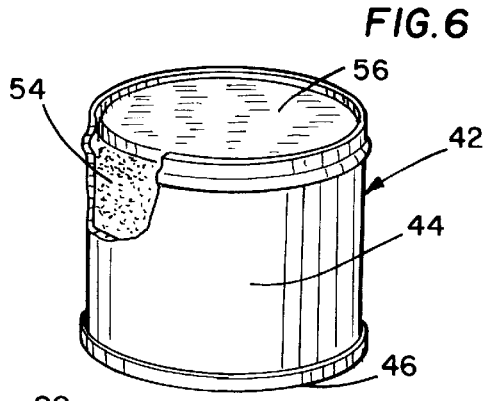
FIG. 6 is a perspective view showing one of the gaskets positioned on top of the surface of the ink in the can.

FIG. 5 shows ink can 42 with lid 48 removed to expose the top surface of a supply of ink 54 in the can. A plurality of disk-like gaskets 56, according to the invention, are shown stacked alongside the open can. The gaskets are slightly smaller in diameter than cylindrical wall 44 of the can, and FIG. 6 shows one of the gaskets positioned on top of the ink 54 in the can. The gaskets are made of such material as coarse rubber and are designed to be readily disposable.

Figure 7:
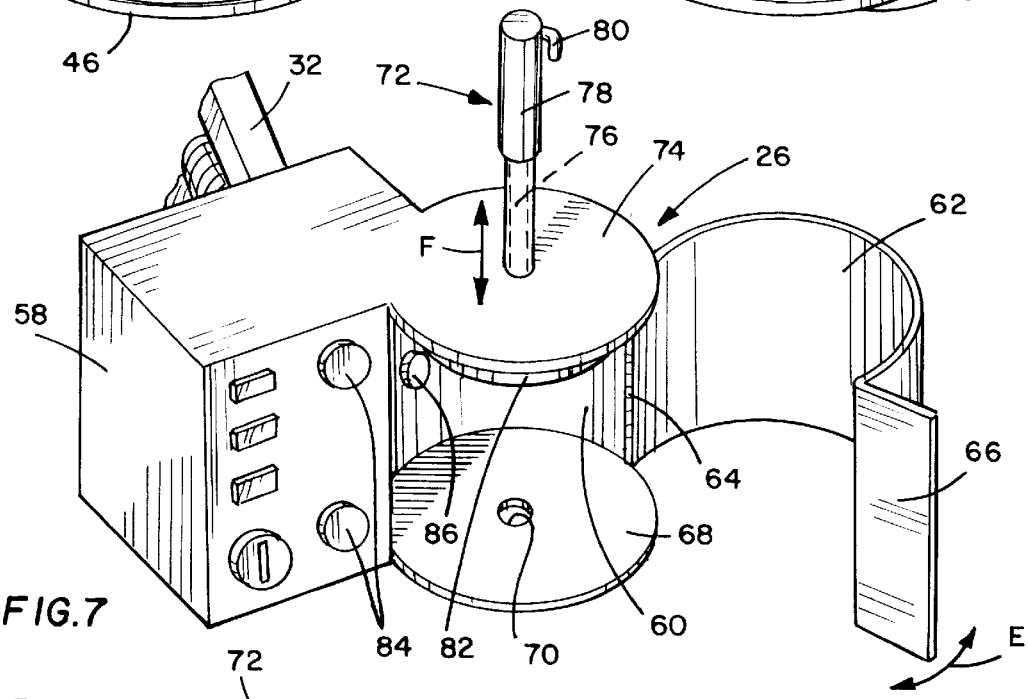
FIG. 7 is a perspective view of the can holder, showing the door of the housing open for receiving a can of ink.

FIG. 7 shows can holder 26 to comprise a housing at one side of a control box 58 and defining a cylindrical interior cavity 60 sized complementary to the configuration of one of the ink cans 42. A semi-cylindrical door 62 is hinged at 64 for closing and opening cavity 16 in the direction of double-headed arrow "E". The free edge of the door has a radially outwardly extending flange 66. The housing has a circular bottom wall 68 provided with an opening 70 which will be in alignment with hole 50 (FIG. 4) in the closed end 46 of ink can 42 when the can is fully positioned in the can holder.

Generally, feeding means are provided for feeding ink 54 from can 42 suspended in can holder 26 above ink fountain 18. More particularly, a piston-and-cylinder device, generally designated 72 (FIGS. 2 and 7), projects upwardly from a top wall 74 of can holder 26. The device includes a piston 76 reciprocal within a cylinder 78 in the direction of double-headed arrow "F" (FIG. 7). A conduit 80 leads from the cylinder to an appropriate pneumatic source (not shown). Piston 76 extends through top wall 74 of can holder 26 and has an enlarged disk-like piston head 82 secured thereto at the underside of top wall 74 within interior cavity 60.

Figure 8:
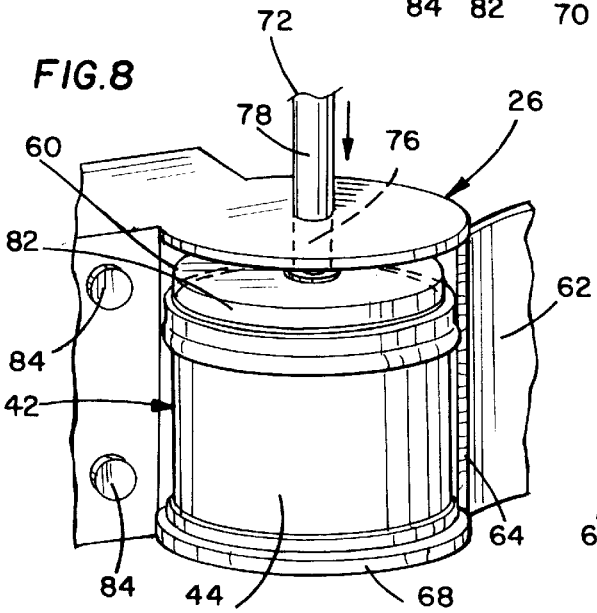
FIG. 8 is a fragmented perspective view somewhat similar to that of FIG. 7, showing a can of ink positioned in the housing.

FIG. 8 shows one of the conventional ink cans 42 positioned within interior cavity 60 of can holder 26 on bottom wall 68 thereof. When so positioned, hole 50 (FIG. 4) in closed end 46 of the can will be in alignment with opening 70 (FIG. 7) in bottom wall 68 of the can holder. Piston head 82 is smaller in diameter than the open end of the ink can for engaging gasket 56 (FIG. 6) which was placed on the top surface of the ink in the can. When piston-and-cylinder device 72 is actuated, piston 76 moves downwardly within cylinder 78 in the direction of arrow "G" to drive piston head 82 against gasket 56 to force ink from the can through hole 50 (FIG. 4) and into ink fountain 18, as at 40 in FIG. 2. The gasket scrapes the inside walls of the can and prevents the ink from getting all over the piston head as well as the interior of can holder 56. The viscosity of the ink prevents the ink from flowing out of hole 50 in the closed end of the can. In other words, the hole should be big enough to allow the ink to be forced there-through, but not so big as to allow the ink to freely flow through the hole.

Figure 9:
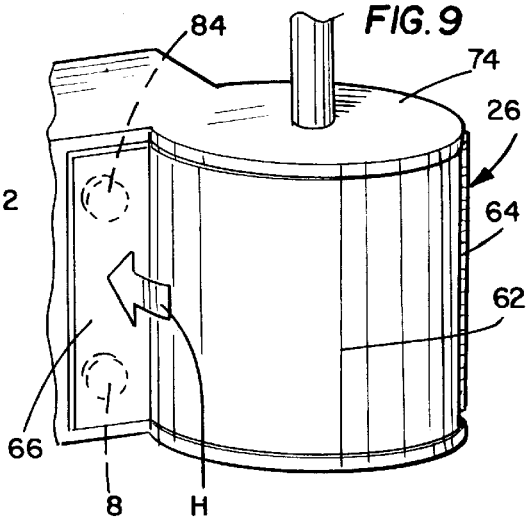
FIG. 9 is a view similar to that of FIG. 8, with the door of the housing closed.

Generally, a normally open switch means is provided on the can holder or housing and operatively associated with piston-and-cylinder device 72 to prevent operation of the device unless door 62 is closed. More particularly, FIGS. 7–9 show a pair of switch contacts 84 which are engageable by flange 46 of the door. Either the door and flange can be conductive to close the contacts, or the contacts can comprise redundant switch buttons which will close a circuit to the piston-and-cylinder device only when the door is closed in the direction of arrow "H" (FIG. 9).

Another normally open switch means is provided on can holder or housing 26 and is operatively associated with the piston-and-cylinder device to prevent the device from operating unless a can 42 is fully positioned in the can holder. More particularly, FIG. 7 shows a switch 86 which are engageable by can 42 which typically is fabricated of conductive metal material.

Finally, FIGS. 1 and 2 show an electronic assembly 88 which has an ultrasonic sensor to sense the level of ink in fountain 18, along with an aiming light which performs a dual function of aligning the ink dispensing and also aligning the level sensor. The sensor is electrically coupled to piston-and-cylinder device 72 to actuate and deactuate the device in response to the sensing of predetermined levels of ink in the ink fountain. The electrical lines between the controls for the piston-and-cylinder device and the sensor, as well as between switch contacts 84 and 86, are not shown in the drawings in order to avoid cluttering the depiction of the invention. Obviously, one of ordinary skill in the art could readily interconnect the sensor and switch contacts to the controls of the piston-and-cylinder device.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. In a printing, duplicating and like machine which includes a printing head having an ink fountain and a plurality of distribution rollers for distributing ink to a printing couple of the machine, an ink feeding system comprising:

a can holder for holding a can of printing ink, including a housing having an interior cavity for receiving the can;

a support for suspending the can holder and can above said ink fountain;

feeding means for feeding ink from the suspended can into the ink fountain; and a normally open switch means on the housing and operatively associated with said feeding means, the switch means being closable by the can positioned within the cavity in the housing.

2. In a printing, duplicating and like machine which includes a printing head having an ink fountain and a plurality of distribution rollers for distributing ink to a printing couple of the machine, an ink feeding system comprising:

a can holder for holding a can of printing ink, including a housing having an interior cavity for receiving the can and a door for closing the cavity;

a support for suspending the can holder and can above said ink fountain;

feeding means for feeding ink from the suspended can into the ink fountain; and a normally open switch means on the housing and operatively associated with said feeding means, the switch means being closable by the door in a closed position.

3. In a printing, duplicating and like machine which includes a printing head having an ink fountain and a plurality of distribution rollers for distributing ink to a printing couple of the machine, an ink feeding system comprising:

a can holder for holding a can of printing ink;

a support for suspending the can holder and can above said ink fountain;

feeding means for feeding ink from the suspended can into the ink fountain; and a normally open switch means on the can holder and operatively associated with said feeding means, the switch means being closable by the can positioned on the can holder.

* * * * *